US005816086A

United States Patent [19]

Russell, IV

[11] Patent Number: 5,816,086

[45] Date of Patent: Oct. 6, 1998

[54] AXIAL MOVING PUSHBUTTON FOR A LOCK HAVING ROTARY LOCKING AND RELEASE MOTIONS

[75] Inventor: Charles G. Russell, IV, Delafield, Wis.

[73] Assignee: Schlage Lock Company, San Francisco, Calif.

[21] Appl. No.: 698,063

[22] Filed: Aug. 15, 1996

[51] Int. Cl.[6] ..... E05B 15/16

[52] U.S. Cl. ..... 70/422; 70/223; 70/472; 292/336.3

[58] Field of Search ..... 70/107, 134, 222–224, 70/218, 422, 461, 467, 472, 476, 480, 489; 292/352, 169, 169.12, 169.14, 336.3, 336.5

[56] References Cited

U.S. PATENT DOCUMENTS

| | | | |
|---|---|---|---|
| 626,340 | 6/1899 | Phelps | 70/472 |
| 777,885 | 12/1904 | Dieringer | 70/472 |
| 2,138,856 | 12/1938 | Harp | 70/216 |
| 2,672,041 | 3/1954 | Heyer | 70/223 |
| 2,829,913 | 4/1958 | North et al. | 292/169 |
| 3,024,055 | 3/1962 | Novarino | 292/169 |
| 3,026,136 | 3/1962 | Russell et al. | 292/336.3 |
| 3,314,708 | 4/1967 | Welch | 292/336.5 |
| 3,390,558 | 7/1968 | Tornoe et al. | 70/107 |
| 3,621,685 | 11/1971 | Sargent | 70/422 X |
| 3,856,339 | 12/1974 | Tornoe et al. | 292/352 X |
| 3,922,896 | 12/1975 | Kagoura | 70/223 |
| 3,954,292 | 5/1976 | Johnson | 292/169.17 |
| 4,195,502 | 4/1980 | Best et al. | 70/422 X |
| 4,201,069 | 5/1980 | Katayama et al. | 70/422 |
| 4,312,201 | 1/1982 | Roos | 70/422 |
| 4,470,278 | 9/1984 | Hale et al. | 70/134 |
| 4,470,279 | 9/1984 | Neary et al. | 70/134 |
| 4,550,581 | 11/1985 | Best et al. | 70/422 |
| 4,631,944 | 12/1986 | Gater et al. | 70/472 |
| 4,838,053 | 6/1989 | Shen | 70/92 |
| 4,920,773 | 5/1990 | Surko, Jr. | 70/224 |
| 4,921,289 | 5/1990 | Shen | 292/336.3 |
| 4,941,697 | 7/1990 | Fan | 70/422 X |
| 5,018,375 | 5/1991 | Tully | 70/472 |
| 5,372,025 | 12/1994 | Lin | 70/472 |
| 5,445,423 | 8/1995 | Mader | 292/336.3 |
| 5,548,981 | 8/1996 | Kirk | 70/422 X |
| 5,598,726 | 2/1997 | Cordle | 70/224 |
| 5,651,280 | 7/1997 | Park | 70/472 |

*Primary Examiner*—Suzanne Dino Barrett
*Attorney, Agent, or Firm*—Michael H. Minns

[57] ABSTRACT

A door lock device has an inside handle assembly and an outside handle assembly. A latch is positioned between the two handle assemblies and there is a spindle which is in rotatable engagement with both handle assemblies and in operable engagement with the latch such that rotation of either handle assembly moves the latch between extended and retracted positions. The inside handle assembly includes an axially movable locking element. A turn bar extends within the spindle and is connected to the locking element. Axial movement of the locking element causes rotation of the turn bar with rotation of the turn bar releasing the spindle from engagement with the outside handle assembly whereby rotation of the outside handle assembly will not rotate the spindle nor move the latch between extended and retracted positions.

36 Claims, 6 Drawing Sheets

AXIAL MOVING PUSHBUTTON FOR A LOCK HAVING ROTARY LOCKING AND RELEASE MOTIONS

THE FIELD OF THE INVENTION

The present invention relates to what is known in the lock industry as a pushbutton interior lock the operation of which prevents entry from the outside. Such pushbuttons are used in both privacy lock sets and keyed entry locks. More specifically, the present invention is directed to an axially movable pushbutton lock which is used in an environment in which the locking motion is rotary.

The invention provides an axially movable pushbutton locking device in which such axial movement is translated into rotary movement of a turn bar which extends between the inside and outside handle assemblies. Rotary movement of the turn bar releases the engagement of the latch turning spindle with the outside handle thereby preventing entry through the door by turning of the outside handle. The axially movable pushbutton is released by turning of the inside handle.

The invention also includes what is known in the lock art as kickoff delay. Rotary movement of the inside handle does not release the axially movable pushbutton and thus reconnect the spindle to the outside handle until the inside handle has been moved through a predetermined arc of handle rotation. Thus, the accidental turning of the inside knob or lever, for example, by the hanging of a garment or accidental striking of the handle will not release the pushbutton. Rather, the inside locking pushbutton can only be released by turning the handle through a predetermined arc of rotation.

The invention further contemplates preventing forced entry from the outside by causing the outside handle to go into free wheeling spinning movement after it has been turned through a predetermined arc when the interior pushbutton is set into a locking position. There are breakable stops which normally limit rotation of the outside handle relative to its housing. However, these stops may be broken by excessive force being applied to the outside handle as during an unauthorized break-in. Such excessive force will only result in fracturing the stops, placing the outside handle in a free wheeling mode.

SUMMARY OF THE INVENTION

The present invention relates to door lock devices and in particular to a pushbutton operated interior lock for use with rotary action locks.

A primary purpose of the present invention is to provide a door lock assembly in which an axially movable interior pushbutton is effective to lock a tubular lock of the type in which there are rotary locking and release motions.

Another purpose of the invention is to provide a lock device as described in which axial movement of a pushbutton is translated into rotation movement of a turn bar, which rotation releases the spindle connecting the exterior handle assembly to the lock latch.

Another purpose is a lock assembly as described which is effective with both keyed entry locks and privacy lock sets.

Another purpose is to provide a locking assembly as described in which release of the interior pushbutton, through rotation of the interior handle, requires rotation through a predetermined arc before release is effective.

Another purpose of the invention is to provide a locking device as described in which any attempt to break in from the outside, through the application of excessive force to the exterior handle, when the inside pushbutton lock is set, will fracture a breakable stop normally limiting outside handle rotation, with the result that the outside handle will become free wheeling, preventing any unauthorized entry.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

The invention will be described in connection with a keyed entry lock, although it is equally applicable to a privacy lockset in which it is desired to prevent unauthorized entry into a room such as a bathroom or a bedroom. The invention will also be described in connection with a conventional door latch. Again, the invention is equally applicable to a deadbolt or to a lock which has a combination deadbolt and latch and in which both of those locking elements are operated by a single set of handles.

Figure 1:
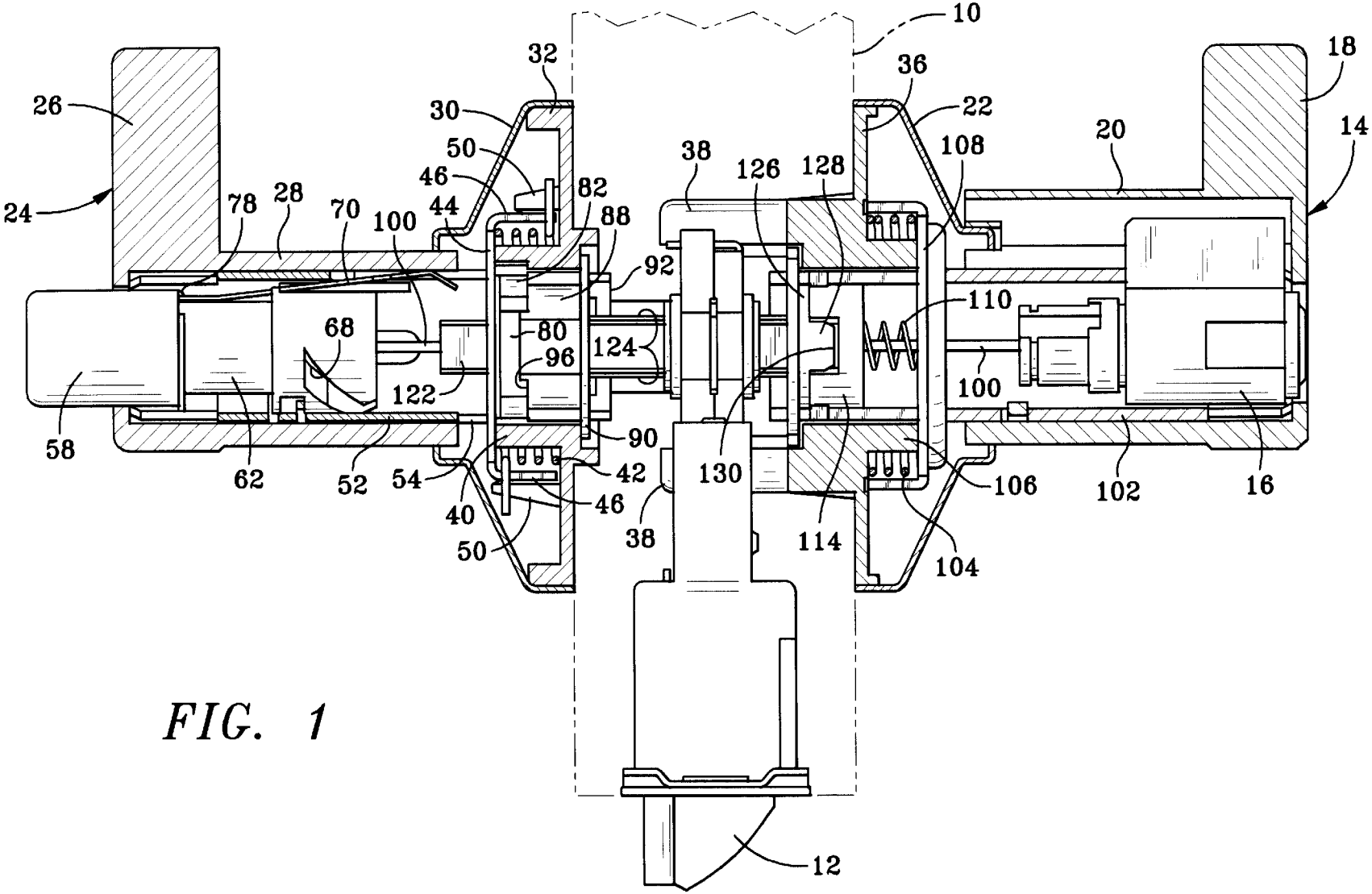
FIG. 1 is an axial section through the door lock device of the present invention showing the pushbutton in a release position.

In FIG. 1, a door is outlined at 10 and the lockset of the present invention is mounted to the door. There is a door latch 12 which extends out of the door edge as is conventional and the lockset will be mounted in suitable bores within the door 10. At the right side of FIG. 1, there is an outside handle assembly 14 which includes a keyed lock cylinder 16. The outside door assembly 14 includes a lever 18, although it could be a door knob, which is attached to and forms a part of a decorative housing 20. There is an escutcheon 22 which encloses a portion of the operating structure of the lock assembly.

On the left side of FIG. 1, there is an inside handle assembly 24 which has an operating lever 26, although again the lock assembly could use a door knob. The lever 26 is integral with a decorative housing 28 and there is an escutcheon 30 which again encloses portions of the lock assembly.

Figure 2:
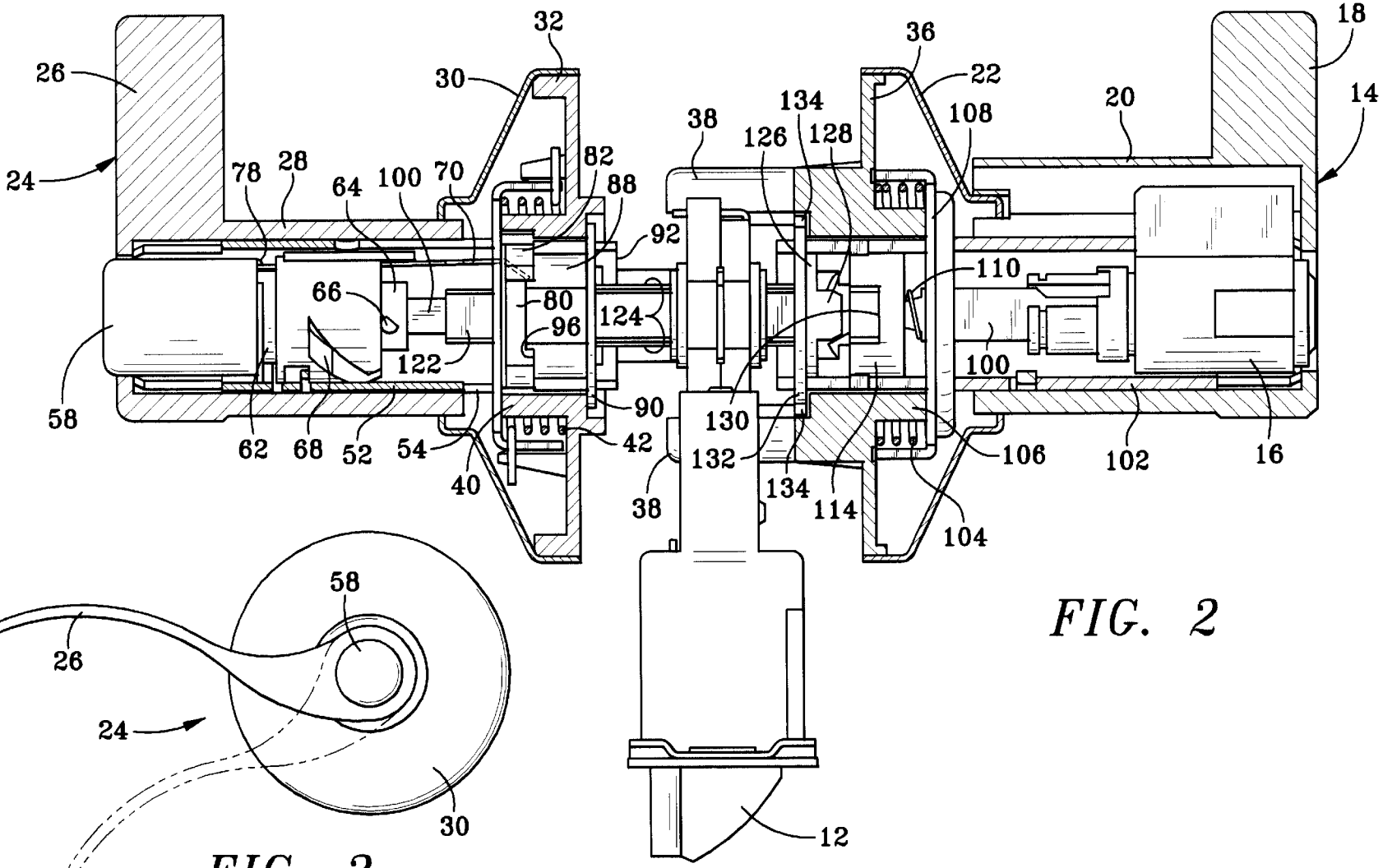
FIG. 2 is an axial section, similar to FIG. 1, but illustrating the pushbutton in a locked position.
Figure 3:
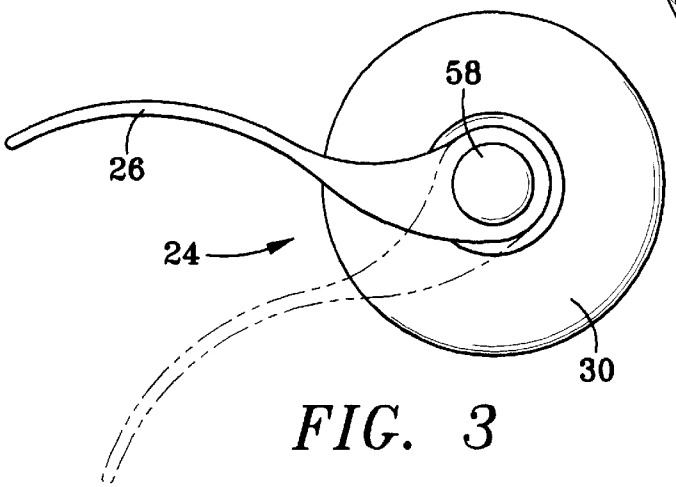
FIG. 3 is an end view, from the left side of FIG. 2, showing the inside handle assembly in its normal position and in a dotted line position at which the pushbutton lock assembly will be released.
Figure 4:
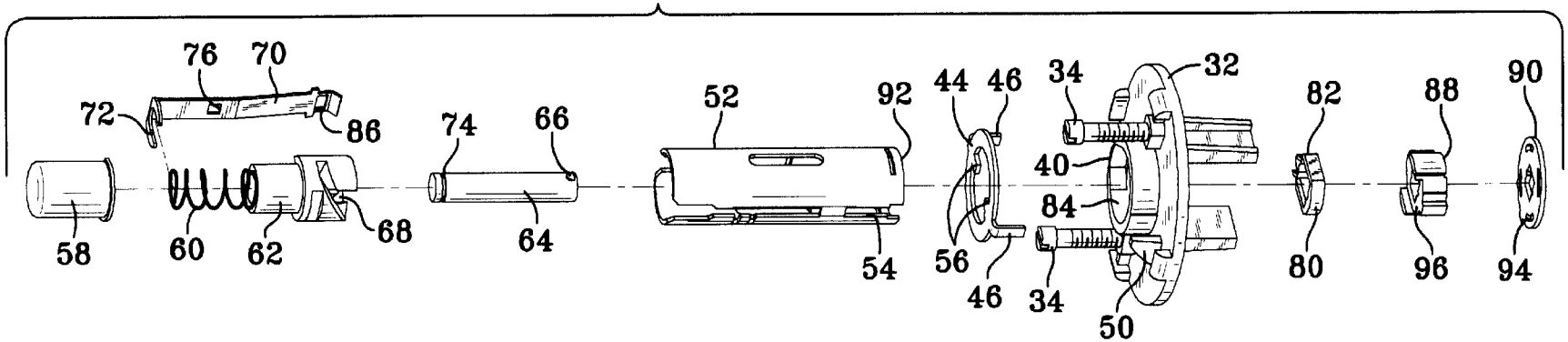
FIG. 4 is an exploded perspective of the interior of the inside handle assembly.

FIG. 1 illustrates the lock assembly with the pushbutton key and lever lock in the release position. FIG. 2 shows the lock assembly in the same manner, but with the pushbutton in the inner locked position. FIG. 3 is a view from the left side of FIGS. 1 and 2 and shows the handle on the inside handle assembly in the normal unoperated position in full lines and in the operated position or turned position in broken lines. The difference in position is the normal distance through which the handle 26 will be moved when the handle is turned to retract the latch 12 so that the door may be opened.

Figure 16:
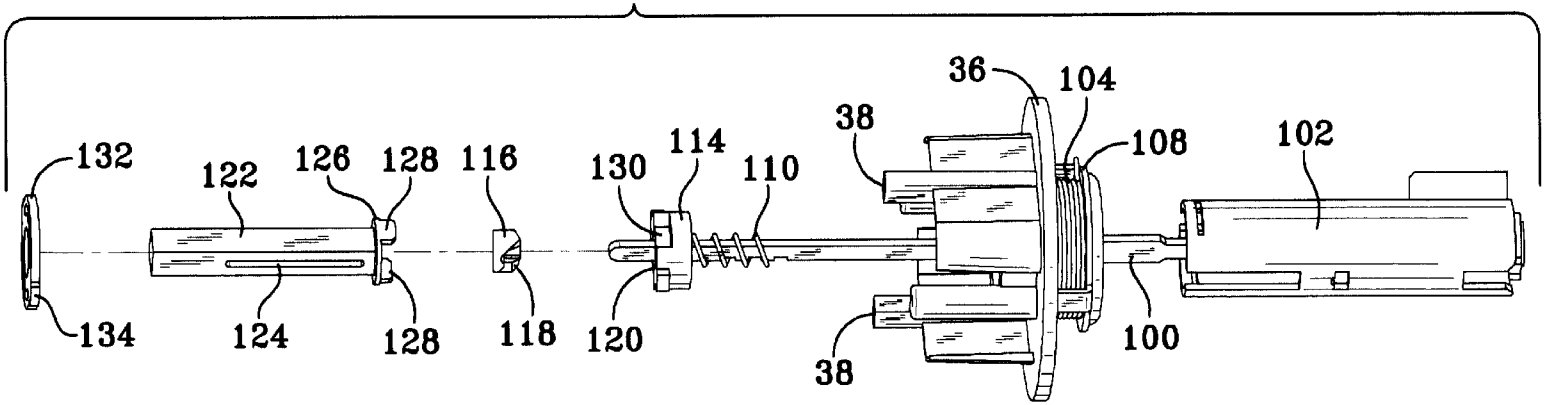
FIG. 16 is an exploded perspective of the outside handle assembly.
Figure 8:
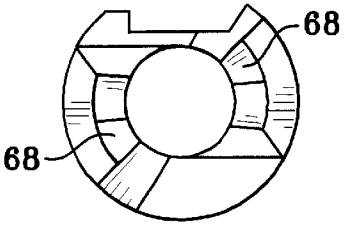
FIG. 8 is an end view of the pushbutton drive.
Figure 6:
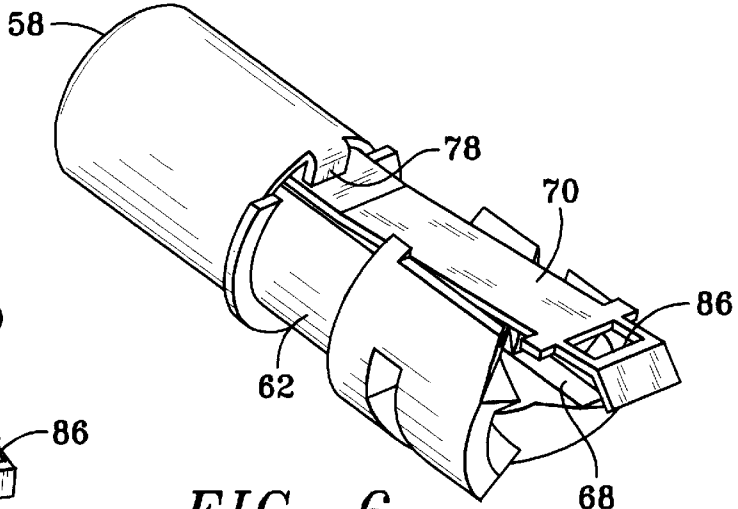
FIG. 6 is a perspective of the pushbutton locking device illustrated in FIG. 5.

FIGS. 4–8 show the interior components of the inside handle assembly and particularly the pushbutton lock. The inside handle assembly housing is indicated at 32 and will be attached by fasteners 34 to the outside handle assembly housing 36. The fasteners 34 will extend into threaded bores in posts 38 which are illustrated in FIG. 16. The inside housing 32 has a generally cylindrical boss 40 about which is mounted a coil spring 42 (FIG. 1) which is held in position by a spring retainer 44. The spring retainer has two axially extending tabs 46 which will engage the opposite ends of the spring 42 so that the spring will urge the inside handle assembly to the unoperated position illustrated in full lines in FIG. 3. Stops for the spring ends are shown at 50 in FIG. 4.

Adjacent the spring retainer 44 is a sleeve 52 which has a pair of diametrically opposed slots 54 through which the inwardly extending projections 56 of the spring retainer extend thus engaging the spring retainer with the sleeve 52.

The pushbutton assembly includes a cap 58 within which is positioned a coil spring 60 which normally biases the cap in an outward direction. The inner end of spring 60 is seated upon a flat top surface of a pushbutton drive 62. The pushbutton drive is hollow and positioned within its hollow interior is a pushbutton 64. Pushbutton 64 has a pair of outwardly extending projections 66 which will ride in helical or spiral tracks 68 formed in the pushbutton drive 62. There are two tracks 68 and there are two projections 66. The pushbutton 64 will extend within cap 58 and will be attached to a flexible pushbutton release 70 by means of a slot 72 in the end of pushbutton release 70 and a groove 74 on the pushbutton. Thus, the pushbutton release and the pushbutton will move simultaneously when the cap 58 is pushed inwardly. The pushbutton release 70 has a small opening 76 which will engage an inwardly extending tab 78 on the cap 58 so that the cap, pushbutton release and pushbutton are all interconnected. This entire assembly will extend within sleeve 52 when the lock assembly is in its fully assembled and ready to use position.

Figure 7:
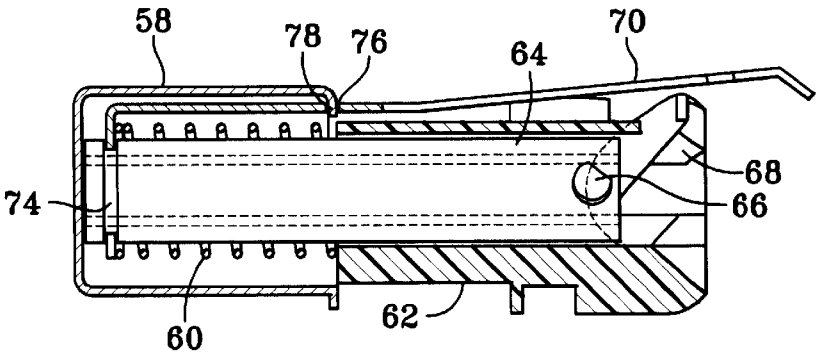
FIG. 7 is an axial section through the pushbutton locking device of FIGS. 5 and 6.
Figure 5:
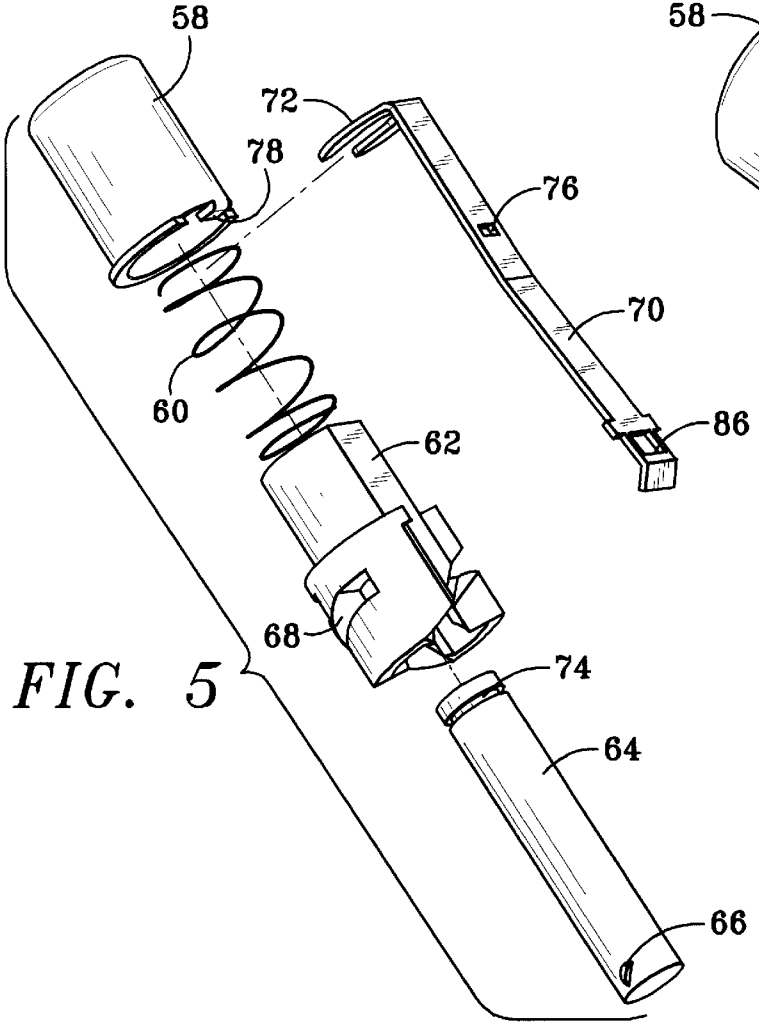
FIG. 5 is an exploded perspective of the pushbutton locking device and related components.

When the cap 58 is pushed in an inward direction against the force of spring 60, pushbutton 64 will also move in an inward direction. However, inward movement of the pushbutton is translated into rotary movement of the pushbutton 64 by the helical tracks 68 on the pushbutton drive 62. As will be explained hereinafter, a turn bar 100 will extend within a rectangular slot within pushbutton 64 with the end result that axial movement of the pushbutton is translated into rotary movement of the turn bar. As illustrated in FIGS. 1 and 7, the interior of pushbutton 64 is hollow which allows the turn bar 100 to be slidably inserted into pushbutton 64 thereby accomodating differing door thicknesses.

Figure 10:
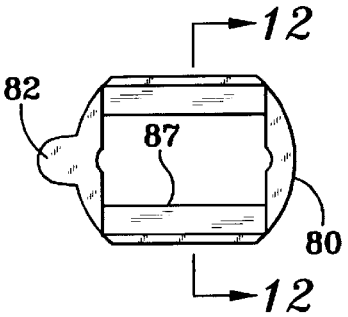
FIG. 10 is a plan view of the pushbutton kickoff element.
Figure 11:
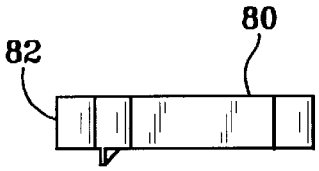
FIG. 11 is a side view of the pushbutton kickoff element.
Figure 12:
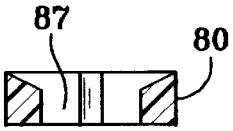
FIG. 12 is a section along plane 12—12 of FIG. 10.

The remaining portions of the inside handle assembly include pushbutton kickoff element 80 shown in FIGS. 10, 11 and 12. The pushbutton kickoff 80 has an outwardly extending cam 82 which cooperates with a cam surface 84 on the inside of handle boss 40 to effect release movement of the pushbutton release 70. In this connection, the inner end of the pushbutton release 70 has an opening 86 which, when the pushbutton is in the inward position of FIG. 2, is engaged with one of the inner projections 56 on the spring retainer 44. This cooperation of elements 86, 56 holds the pushbutton in the inward or locked position until the handle is turned as will be explained hereinafter. The pushbutton kickoff 80 is positioned within the boss 40 of the housing 32 for back and forth movement in a direction perpendicular to the axis of handle rotary movement. Pushbutton kickoff 80 uses a central rectangular opening 87 for passage of the lockset spindle 122.

Figure 13:
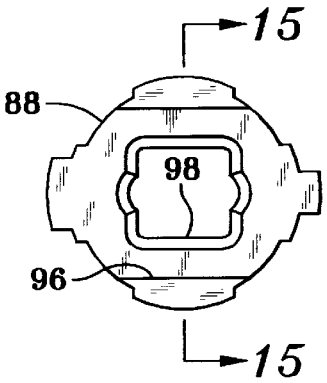
FIG. 13 is a plan view of the outside of the spindle guide.
Figure 14:
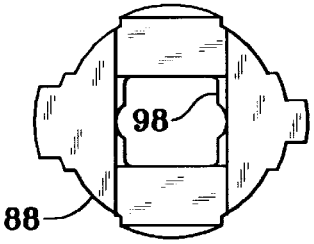
FIG. 14 is a plan view of the inside of the spindle guide.
Figure 15:
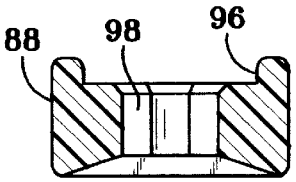
FIG. 15 is a section along plane 15—15 of FIG. 13.

There is a spindle guide 88 which is also positioned within the boss 40 and finally the assembly is completed by a retainer 90. The retainer 90 cooperates with the end portion 92 of sleeve 52 to hold the entire described assembly to the inside handle assembly housing 32. The ends 92 of sleeve 52 will extend through slots 94 in the retainer 90 and then be staked to assure connection of all of the described elements. The spindle guide 88 is shown in detail in FIGS. 13, 14 and 15 and includes on one side a slot 96 which is of a size and shape to permit back and forth movement of the pushbutton kickoff 80. Note particularly FIG. 4 where the disposition of these elements is clearly shown. The spindle guide 88 has an interior passage 98 which will accept the spindle 122 for concurrent movement of the inside handle and the spindle.

Figure 17:
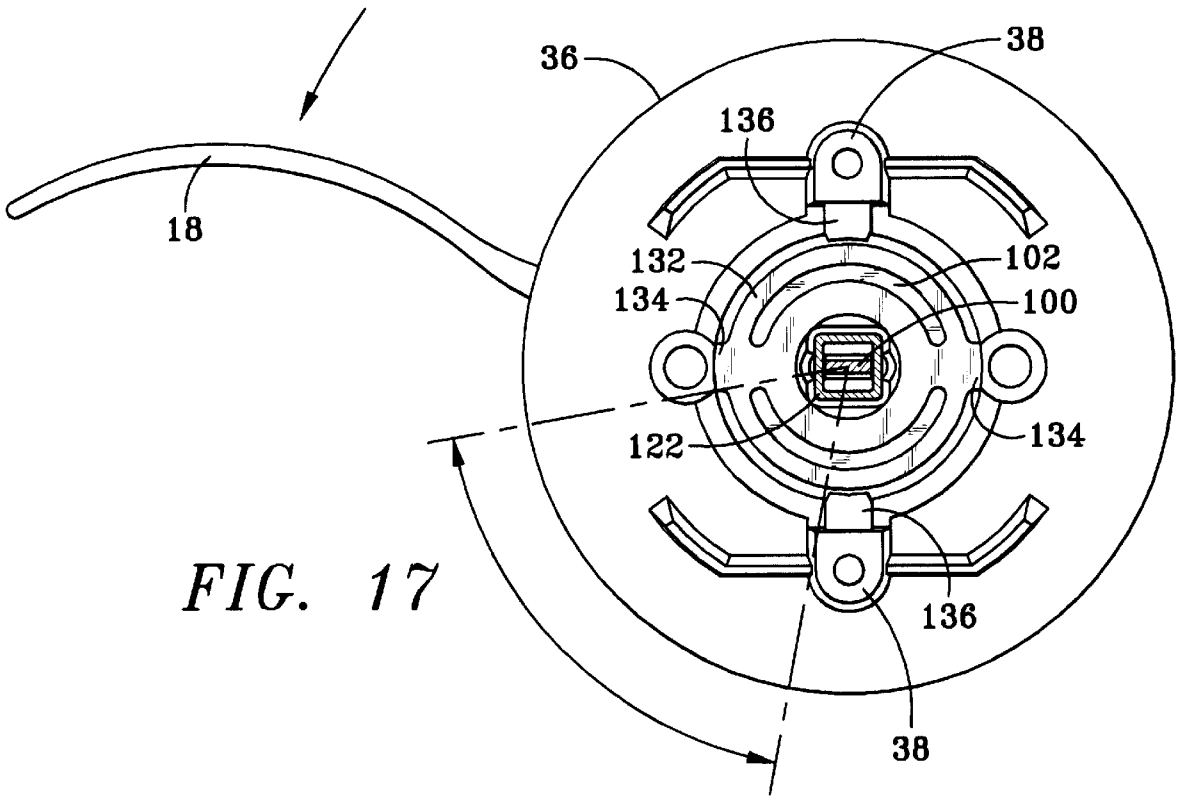
FIG. 17 is a view from the door side of the outside handle assembly showing the arc of rotation prior to contact between the handle stops and the housing stops.
Figure 18:
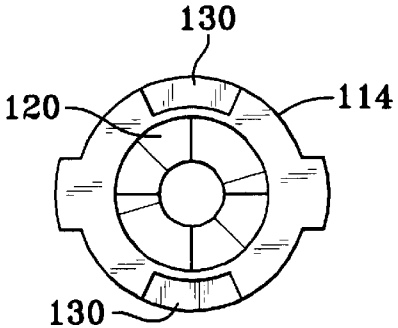
FIG. 18 is a plan view of the locking cam.
Figure 20:
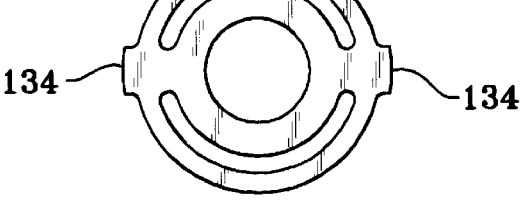
FIG. 20 is a plan view of the sleeve retainer.
Figure 19:
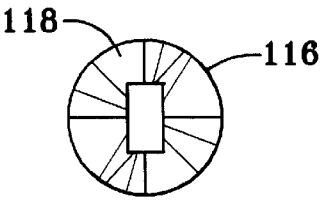
FIG. 19 is a plan view of the cam follower.

Focusing on FIGS. 16, 17 and 18, the outside handle assembly includes the described housing 36 with the threaded bosses 38. The turn bar 100 extends outwardly from a sleeve 102 which is positioned within that portion of the handle 20 shown in FIGS. 1 and 2. There is a coil spring 104 mounted on a boss 106 of the outside handle housing 36 which spring is held in position by a spring retainer 108 and again will urge the outside handle into a normally inoperative position in which the latch bolt is extended outwardly. The turn bar 100 extends through the housing 36 and carries a coil spring 110 which has one end engaged with the turn bar with the other end being urged against a locking cam 114. The turn bar will extend through a round opening in the locking cam 114 such that rotation of the turn bar will not turn the locking cam. Positioned adjacent the locking cam and also mounted on the turn bar 100 is a cam follower 116. The cam follower has a rectangular slot of a size and shape to receive the turn bar and be rotatable therewith. The cam follower 116 has an internal cam surface 118 which will interact with a cam surface 120 on the facing side of locking cam 114 with the result that rotation of the turn bar 100 will cause the locking cam to move away from the cam follower against the force of spring 110.

A spindle is indicated at 122 and has the customary generally rectangular configuration with axially extending beads 124 on each side thereof. The turn bar 100 will extend inside of the spindle 122 and will extend into the inside handle assembly as particularly shown in FIGS. 1 and 2. The spindle 122 has an end with an outwardly extending flange 126 and two axially extending projections 128. The projections 128 will extend into recesses 130 on the locking cam when the lock assembly is in the position of FIG. 1 and the pushbutton has not been depressed.

FIG. 17 is a view from the inside of the housing 36 and shows the position of a retainer 132 as it rotates with the spindle as the handle 18 is operated. The retainer 132 has two outwardly extending tabs 134. The outside handle housing 36 has inwardly extending stops 136. The tabs 134 and the stops 136 normally limit the rotation of the outside handle to that which is necessary to effect retraction of the latch mechanism as is customary in door lock sets. However, either or both of the tabs 134 and the stops 136 are breakable. Normally, when the outside handle is turned the stops and tabs will restrict movement to that necessary to release the latch. However, if the inside pushbutton lock has been operated, turning of the outside handle will not rotate the spindle with the result that the inside lock will not be released nor will the latch be retracted as it is rotation of the spindle which moves the latch bolt between extended and retracted positions. However, if excessive force is applied to the outside handle when the pushbutton is operated, as in an attempt at forced entry, the tabs and stops, either one or both of such elements, will break with the result that the outside handle will then become free wheeling. It may turn continuously but since the spindle is not then attached to the outside handle, such turning will not release the latch and the door cannot be opened. Once the pushbutton lock is released and the spindle reconnected to the outside handle, operation is normal except there are no stops on movement of the outside handle.

In normal operation of the lock assembly, as shown in FIG. 1, the spindle 122 through its projections 128 is engaged with the locking cam 114. The locking cam is engaged with the turn bar through the cam follower 116. The turn bar is engaged with the outside handle and the spindle is engaged with the inside handle. Thus, if either inside or outside handle is turned, the spindle will rotate. Such rotation of the spindle, which extends through the latch 12, will cause the latch bolt to be retracted, permitting the door to be opened.

When the pushbutton cap 58 is pushed inward, the pushbutton 64 will rotate, causing the turn bar to rotate. The pushbutton 64 will also move in an inward direction carrying the pushbutton release 70 with it. As the pushbutton release moves inwardly, its opening 86 will catch upon one of the inwardly extending projections 56 holding the pushbutton in an inward locked position as shown in FIG. 2. Rotation of pushbutton 64 will cause the turn bar to rotate without consequent rotation of the spindle. As the turn bar rotates, it will cause cam follower 116 to rotate which, through the mating cam surfaces 118 and 120 will move locking cam 114 in an axial direction toward the right in FIG. 16, against the force of spring 10. Such movement of the locking cam releases the connection between the locking cam and the spindle. Once this release has been effected, rotation of the outside handle cannot turn the spindle with the result the turning of the outside handle cannot retract the latch 12.

Figure 9:
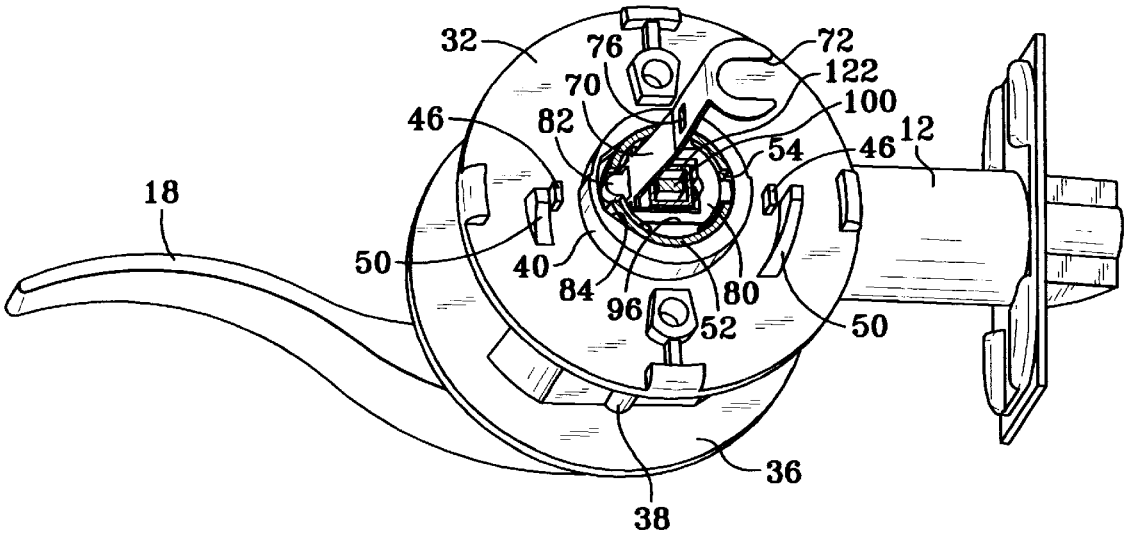
FIG. 9 is a perspective, from the inside, showing the lock assembly, with the inside escutcheon and certain elements of the pushbutton locking device removed.

In order to release the described pushbutton assembly, which, as is clear from the above description, translates axial movement of the pushbutton into rotary movement of the turn bar, it is only necessary to turn the inside handle 26 through the arc illustrated in FIG. 3. As the sleeve 52 is rotated with handle 26, it will cause turning movement of pushbutton kickoff 80 and as the pushbutton kickoff 80 turns its cam 82 will ride against the cam surface 84 shown in FIG. 9. The result is that the kickoff element 80 will be forced to move in a left to right direction as shown in FIG. 9 causing movement of the pushbutton release element 70 from its connection with an inward projection 56 on the spring retainer 44. As soon as this release is effected, spring 60 causes the entire pushbutton assembly to return to the full release position of FIG. 1. Thus, rotation of the inside handle causes sliding movement of kickoff element 80 which in turn permits release of the pushbutton.

In this connection, release of the pushbutton does not take place upon the first instant of rotation of handle 26. Rather, it is necessary to rotate the handle through a predetermined arc, for example, approximately 45° as illustrated in FIG. 3. This is required because the kickoff element 80 must move a sufficient distance before its cam 82 through contact with shoulder 84 will cause the necessary translational movement of the kickoff element to release the release element 70 and thus permit outward axial movement of the pushbutton assembly. Thus, there is kickoff delay and there is not immediate release of the pushbutton until the handle 26 has been moved through its full permitted predetermined arc. The kickoff delay is a combination of the shape of cam surface 84 and the size of cam 82.

The above type of movement is desirable in that at times someone may place an article, for example clothing, purse or the like, on the inside handle and the weight of such an object should not cause release of the lock. The lock should only be released when it is turned through its full programmed arc of movement.

Of importance in the invention is the use of an axially movable locking button to effect rotation of a turn bar in a lock which is moved in a rotary manner between extended and retracted positions. The axially movable pushbutton must have its movement translated into rotary movement of the turn bar before the locking procedure can be complete. Thus axial movement of the pushbutton is translated into rotary movement of the turn bar with rotary movement of the turn bar releasing the spindle from its connection with the outside handle thereby denying entry from the outside when the pushbutton has been operated.

A further important feature of the invention is the delay in release of the pushbutton until the handle has been moved through its predetermined arc before unlocking can take place.

An additional feature of the invention is the breakable or frangible tabs and stops on the outside handle assembly whereby unauthorized entry cannot be effected even though excessive force may be applied to the outside handle. In prior locksets of the type disclosed herein, it was possible to break through the stops which prevented the outside handle from operating the spindle with the result that it was possible to have forced entry. In the present invention, once the stops are broken the outside handle is totally free wheeling and there is no way that entry can be effected.

Whereas the preferred form of the invention has been shown and described herein, it should be realized that there may be many modifications, substitutions and alterations thereto.

The embodiments of the invention in which an exclusive property or privilege is claimed are defined as follows:

1. A door locking device having an inside handle assembly and an outside handle assembly, a latch positioned intermediate said handle assemblies, a spindle in rotatable engagement with both of said handle assemblies and in operable engagement with said latch whereby rotation of either handle assembly moves said latch between extended and retracted positions, said inside lock assembly including an axially movable locking element accessible from the exterior of said inside handle assembly, a rotatable turn bar extending within said spindle and connected to said locking element, means for translating axial movement of said locking element into rotation of said turn bar, means for retaining said axially movable locking element in an inward locked position, release means for releasing said means for retaining said locking element in an inward position in response to rotation of said inside handle assembly.

2. The door locking device of claim 1 wherein the means for translating axial inward movement of said locking element into rotation of said turn bar includes a drive element, a pushbutton positioned therein, cam means connecting said pushbutton and drive element whereby axial movement of said drive element causes rotation of said pushbutton, said turn bar being engaged with said pushbutton for simultaneous rotation therewith.

3. The door locking device of claim 2 wherein said cam means includes outwardly extending projections on said pushbutton and spiral shaped grooves in said drive element.

4. The door locking device of claim 2 including spring means positioned between said drive element and said locking element normally urging said locking element outwardly of said inside handle assembly.

5. The door locking device of claim 2 wherein the means for retaining said axially movable locking element in an inward locked position includes a release element attached to said pushbutton and having a catch at an inner end thereof.

6. The door locking device of claim 5 wherein said release element is elongated and flexible.

7. The door locking device of claim 5 wherein said release element catch includes an opening at an inner end of said release element and a cooperating projection on said inside handle assembly.

8. The door locking device of claim 7 including means for moving said release element opening away from said cooperating projection in response to rotation of said inside handle assembly.

9. The door locking device of claim 8 wherein said release means includes a pushbutton kickoff element having a cam thereon, a cooperating ramp on said inside handle assembly such that rotation of said inside handle assembly turns said kickoff element relative to said ramp, with movement of said kickoff element causing release motion of said release element.

10. The door locking device of claim 9 wherein said inside handle assembly includes a fixed housing, said ramp being located on said fixed housing.

11. The door locking device of claim 10 wherein movement of said kickoff element to cause release movement of said release element requires a predetermined rotation of said inside handle assembly relative to said housing.

12. The door locking device of claim 5 including means for connecting said release element to said locking element for simultaneous movement therewith.

13. The door locking device of claim 1 further comprising:

means for delaying the operation of the release means until said inside handle assembly has been rotated a predetermined rotation.

14. The door locking device of claim 1 further comprising:

means interconnecting said turn bar and said spindle whereby rotation of said turn bar relative to said spindle, in response to axial movement of said locking element, releases said spindle from rotational engagement with said outside handle assembly such that rotation of said outside handle assembly will not rotate said spindle nor move said latch between extended and retracted positions, axial movement of said locking element in an outward direction causing rotation of said turn bar, with rotation of said turn bar reengaging said spindle and said outside handle assembly.

15. The door locking device of claim 14 wherein the means interconnecting said spindle and turn bar includes a locking cam engageable with said spindle and a cam follower engaged with said turn bar, rotation of said turn bar causing said cam follower to move said locking cam away from engagement with said spindle.

16. The door locking device of claim 15 wherein said cam follower has a slot of a size and shape to receive said turn bar and cause simultaneous rotation therewith.

17. The door lock device of claim 16 wherein said locking cam has a coaxial opening receiving said turn bar and permitting rotation of said turn bar relative to said locking cam.

18. The door locking device of claim 15 wherein said locking cam has diametrically opposed recesses, with said spindle having axially extending projections normally positioned within the said locking cam recesses for simultaneous rotation of said locking cam and spindle.

19. The door locking device of claim 18 including spring means positioned about said turn bar and normally biasing said locking cam into engagement with said spindle.

20. The door locking device of claim 15 wherein said locking cam and cam follower have interengaging and cooperating cam surfaces thereon whereby rotation of said cam follower relative to said locking cam causes said elements to move in opposite directions.

21. The door locking device of claim 1 wherein said outside handle assembly includes a rotatable handle and a housing adapted to be fixed to a door, breakable stop means limiting rotation of said handle relative to said housing, fracturing of said breakable stop means permitting free rotation of said outside handle relative to said outside housing.

22. The door locking device of claim 21 wherein said breakable stop means includes a pair of inwardly directed projections on said housing and a pair of outwardly directed projections on said rotatable handle.

23. A door locking device having an inside handle assembly and an outside handle assembly, a latch positioned intermediate said handle assemblies, a spindle in rotatable engagement with both of said handle assemblies and in operable engagement with said latch whereby rotation of either handle assembly moves said latch between extended and retracted positions, said inside handle assembly including a movable locking element accessible from the exterior of said inside handle assembly, means for disengaging said spindle from said outside handle assembly in response to movement of said locking element such that rotation of said outside handle assembly will not rotate said spindle nor move said latch between extended and retracted positions, said outside handle assembly including a rotatable handle and a housing adapted to be fixed to a door, and breakable stop means limiting rotation of said outside handle relative to said outside housing, with fracturing of said breakable stop means permitting free rotation of said outside handle relative to said outside housing.

24. The door locking device of claim 23 wherein said locking element is axially movable, a turn bar extending within said spindle and connected to said axially movable locking element, means for translating axial movement of said locking element into rotation of said turn bar, means interconnecting said turn bar and spindle whereby rotation of said turn bar relative to said spindle, in response to axial movement of said locking element, releases said spindle from rotational engagement with said outside handle assembly.

25. A door lock comprising:

an inside handle assembly;

an outside handle assembly;

a latch positioned intermediate the handle assemblies;

a spindle in rotatable engagement with both of the handle assemblies and in operable engagement with the latch whereby rotation of the spindle moves the latch between an extended position and a retracted position; and a rotatable turn bar in operable engagement with the outside handle assembly and the spindle;

the inside lock assembly including an axially moveable pushbutton assembly accessible from the exterior of the inside handle, the pushbutton assembly including a cam means for translating axial movement of the push button assembly into rotation of the turn bar.

26. The door lock according to claim 25, wherein the pushbutton assembly further comprises a hollow pushbutton, the turn bar slidably engaging the hollow pushbutton.

27. The door lock according to claim 25, further comprising:

a retention means for retaining the axially moveable pushbutton assembly in an inward locked position; and a delay assembly releasing the retention means after a predetermined rotation of the inside handle assembly.

28. The door lock according to claim 27, wherein the delay assembly comprises a pushbutton kickoff element having a cam thereon; and a cooperating ramp on the inside handle assembly, the cooperating ramp engaging the cam, rotation of the inside handle assembly rotating the pushbutton kickoff element relative to the ramp, thereby causing sliding movement of the pushbutton kickoff element, the sliding movement of the pushbutton kickoff element releasing the retention means.

29. The door lock according to claim 25, wherein the pushbutton cam means includes a pushbutton drive having camming grooves thereon and a pushbutton having outwardly extending projections engaging the camming grooves.

30. The door lock according to claim 29, wherein the projections are disengaged from the camming grooves when the axially moveable pushbutton assembly is in an inward locked position.

31. The door lock according to claim 25, further comprising:

a retention means for retaining the axially moveable pushbutton assembly in an inward locked position, the retention means including a release element having an engagement member at an outward end thereof; and the axially moveable pushbutton assembly including a pushbutton, the engagement member rotatably engaging the pushbutton.

32. The door lock according to claim 25, further comprising:

a clutch means for interconnecting the turn bar and the spindle whereby rotation of the turn bar in response to inwardly axial movement of the pushbutton assembly releases the spindle from rotational engagement with the outside handle assembly and whereby rotation of the turn bar in response to outwardly axial movement of the pushbutton assembly moves the spindle into rotational engagement with the outside handle assembly.

33. The door lock according to claim 25, wherein the outside handle assemble includes a rotatable handle and a housing; and further comprising:

a breakable stop means for limiting rotation of the handle relative to the housing, the breakable stop means including breakable projections on the handle, the housing breakable projections interacting with the handle breakable projections to limit rotation of the handle relative to the housing.

34. The door lock according to claim 33, wherein the breakable projections break at a predetermined torque thereby permitting the outside handle to free wheel.

35. The door lock according to claim 27, wherein the retention means includes a release element having an engagement member at an outward end thereof; and the axially moveable pushbutton assembly includes a pushbutton, the engagement member rotatably engaging the pushbutton.

36. A door lock comprising:

an inside handle assembly;

an outside handle assembly;

a latch positioned intermediate the handle assemblies;

a spindle in rotatable engagement with both of the handle assemblies and in operable engagement with the latch whereby rotation of the spindle moves the latch between an extended position and a retracted position;

a rotatable turn bar in operable engagement with the outside handle assembly and the spindle;

the inside lock assembly including an axially moveable pushbutton assembly accessible from the exterior of the inside handle, the pushbutton assembly including a cam means for translating axial movement of the push button assembly into rotation of the turn bar;

a retention means for retaining the axially moveable pushbutton assembly in an inward locked position; and a delay assembly releasing the retention means after a predetermined rotation of the inside handle assembly.

* * * * *